US008579411B2

(12) United States Patent
Kim et al.

(10) Patent No.: US 8,579,411 B2
(45) Date of Patent: Nov. 12, 2013

(54) DISCHARGING NOZZLE AND ELECTROSTATIC FIELD INDUCTION INK-JET NOZZLE

(75) Inventors: Yong Jae Kim, Gyeonggi-do (KR); Sukhan Lee, Gyeonggi-do (KR); Hanseo Ko, Seoul (KR); Sang Uk Son, Gyeongsangbuk-do (KR); Soo Hong Lee, Daegu (KR); Ki Chul An, Daegu (KR); Jaeyong Choi, Seoul (KR)

(73) Assignee: Sungkyunkwan University Foundation For Corporate Collaboration, Gyeonggi-do (KR)

( * ) Notice: Subject to any disclaimer, the term of this patent is extended or adjusted under 35 U.S.C. 154(b) by 241 days.

(21) Appl. No.: 12/713,886

(22) Filed: Feb. 26, 2010

(65) Prior Publication Data

US 2011/0199433 A1 Aug. 18, 2011

(30) Foreign Application Priority Data

Feb. 18, 2010 (KR) ..... 10-2010-0014785

(51) Int. Cl.
*B41J 2/14* (2006.01)
*B41J 2/06* (2006.01)

(52) U.S. Cl.
USPC ..... 347/47; 347/55

(58) Field of Classification Search
USPC ..... 347/47, 55
See application file for complete search history.

(56) References Cited

U.S. PATENT DOCUMENTS 4,801,954 A * 1/1989 Miura et al. ..... 347/21
2004/0174411 A1* 9/2004 Sumiya et al. ..... 347/47

FOREIGN PATENT DOCUMENTS

JP 2007276256 A * 10/2007
WO WO 2004006627 A1 * 1/2004

OTHER PUBLICATIONS

Machine Translation of JP2007276256A, Paragraphs 34-36, see also Fig. 12.*

* cited by examiner

*Primary Examiner* — Lisa M Solomon
(74) *Attorney, Agent, or Firm* — Grossman Tucker Perreault & Pfleger, PLLC

(57) ABSTRACT

A nozzle and an electrostatic field induction ink-jet nozzle are disclosed. In accordance with an embodiment of the present invention, the nozzle includes a concave part, which is formed along an outer circumference of the nozzle and in which the outer circumference is adjacent to a liquid discharging surface. The discharging nozzle can minimize the overflow and damping by a liquid during a process of discharging the liquid and thus maintain the discharging performance constant despite an extended operation of the nozzle.

16 Claims, 17 Drawing Sheets

DISCHARGING NOZZLE AND ELECTROSTATIC FIELD INDUCTION INK-JET NOZZLE

CROSS-REFERENCE TO RELATED APPLICATIONS

This application claims the benefit of Korean Patent Application No. 10-2010-0014785, filed with the Korean Intellectual Property Office on Feb. 18, 2010, the disclosure of which is incorporated herein by reference in its entirety.

BACKGROUND

1. Technical Field

The present invention is related to a nozzle, more specifically to a nozzle that has an excellent stability in discharging performance.

2. Description of the Related Art

An electrostatic field induction ink-jet head or ElectroHydroDynamic (EHD) ink-jet head discharges a portion of an ink droplet by forming an electric field while the liquid is formed at an end part of a nozzle of the ink-jet head.

With the repeated discharging of liquid through the nozzle associated with use, however, a portion of the liquid formed at the end part of the nozzle may wet the outer wall of the nozzle, making the discharging performance (for example, the direction, rate and size of the discharged liquid) unstable.

SUMMARY

The present invention provides a nozzle that can provide an excellent stability in discharging performance.

The present invention also provides a nozzle that can minimize the overflow and damping by a liquid during a process of discharging the liquid.

Furthermore, the present invention provides a nozzle that can maintain the discharging performance constant despite an extended operation of the nozzle.

An aspect of the present invention provides a discharging nozzle that includes a concave part, which is formed along an outer circumference of the nozzle and in which the outer circumference is adjacent to a liquid discharging surface.

The concave part can be formed in the shape of a ring-shaped band at the outer circumference of the nozzle.

A plurality of concave parts can be formed in a lengthwise direction of the nozzle.

A hydrophobic coating membrane can be coated on a surface of the concave part.

A surface of the concave part can be made of a hydrophobic material.

Among two side walls formed by the concave part, an angle formed by a first side wall and a base part of the concave part can be an acute angle, in which the first side wall is closer to the liquid discharging surface.

Among two side walls formed by the concave part, an angle formed by a first side wall and a base part of the concave part can be an obtuse angle, in which the first side wall is closer to the liquid discharging surface, and an inclined surface of the obtuse angle formed by the first side wall can be extended to the liquid discharging surface.

An inclined surface can be formed along a perimeter of the liquid discharging surface, and the inclined surface can be extended to a start point of a side wall of the concave part.

Another aspect of the present invention provides an electrostatic field induction ink-jet nozzle that discharges ink by using an electrostatic field formed by a difference in electric potential of electrodes. Here, the nozzle includes a concave part, which is formed along an outer circumference of the nozzle and in which the outer circumference is adjacent to a liquid discharging surface.

The concave part can be formed in the shape of a ring-shaped band at the outer circumference of the nozzle.

Additional aspects and advantages of the present invention will be set forth in part in the description which follows, and in part will be obvious from the description, or may be learned by practice of the invention.

DETAILED DESCRIPTION

Figure 1A:
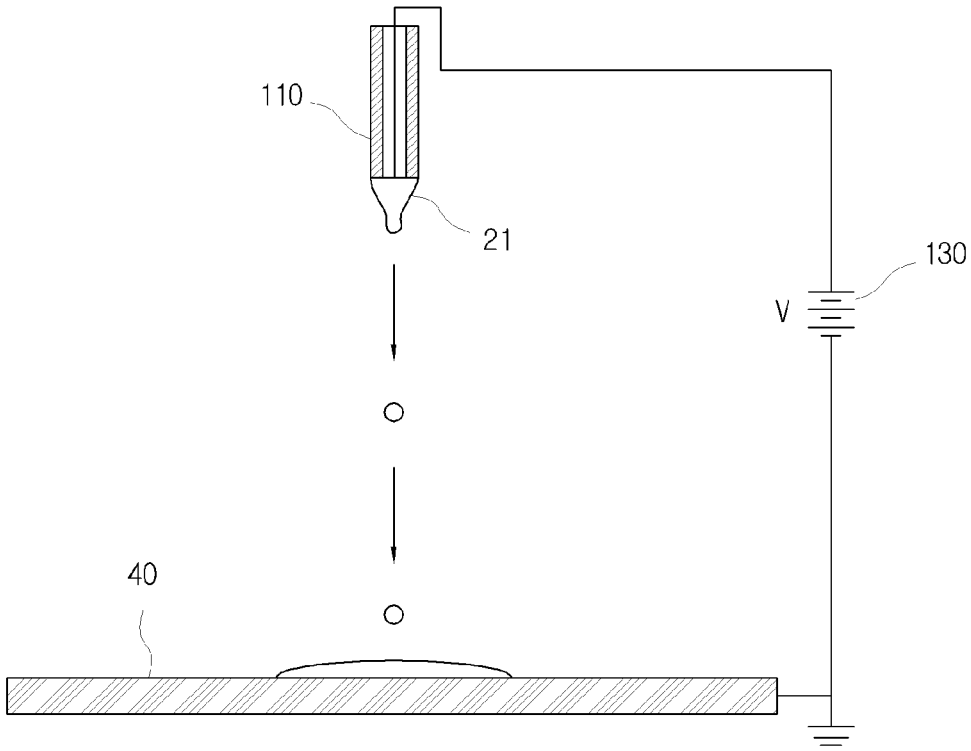
FIGS. 1A to 1C illustrate the operating principle of an electrostatic field induction ink-jet head.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention.

In the description of the present invention, certain detailed explanations of related art are omitted when it is deemed that they may unnecessarily obscure the essence of the invention. While such terms as "first" and "second," etc., may be used to describe various components, such components must not be limited to the above terms. The above terms are used only to distinguish one component from another.

Before describing a discharging nozzle according to certain embodiments of the present invention with reference to the accompanying drawings, the operating principle of an electrostatic filed induction ink-jet head, to which the discharging nozzle in accordance with certain embodiments of the present invention can be applied, will be described by referring to FIGS. 1A to 1C.

Figure 1B:
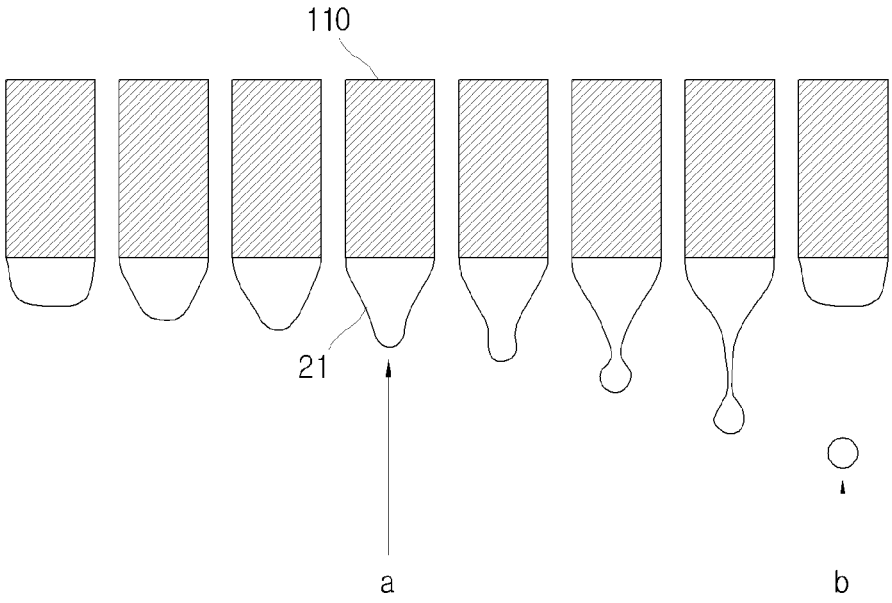
Figure 1C:
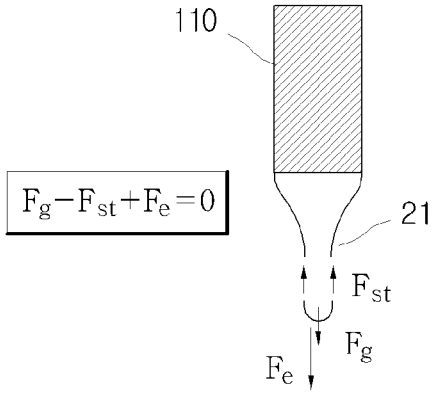

FIGS. 1A to 1C illustrate the operating principle of an electrostatic field induction ink-jet head.

FIG. 1A is a conceptual diagram illustrating a simple example of applying an operating voltage between electrodes. Specifically, it is assumed in FIG. 1A that an electrode to which an operating voltage is to be applied is positioned directly or adjacent to a nozzle 110 and another electrode is positioned directly or adjacent to a print object 40.

In FIG. 1A, only one source of direct current (DC) is implemented as an operating power source 130. However, it shall be construed that this is only illustrated as a test power source and does not further imply any other meaning. Likewise, it shall be appreciated that the connection method of an operating circuit illustrated in FIG. 1A is a conceptual connection method for an example or test.

Furthermore, even though it is assumed and illustrated in FIG. 1A that a second electrode, which is a common electrode, is grounded and an operating voltage is applied individually to a first electrode so that each nozzle is individually operated, it shall be evident that various other modifications are possible.

In the electrostatic field induction ink-jet head illustrated above, ink is discharged through the nozzle 110 by the electrostatic gravitation induced between the two electrodes. This will be described below with reference to FIGS. 1B and 1C.

With a change (i.e., increase) in the electrostatic gravitation induced between the electrodes that is caused by a change (i.e., increase) in the operating voltage applied by the operating power source 130, a meniscus 21 of ink formed on a discharging surface of the nozzle 110 is also sequentially changed as illustrated in FIG. 1B. That is, the ink formed on the discharging surface becomes increasingly condensed, with the increase in the electrostatic gravitation between the electrodes.

Until the critical state (for example, the state indicated by a in FIG. 1B), in which a portion of the ink formed on the ink discharging surface is about to fall down, equilibrium is maintained between a force acting in the direction of discharging the ink (that is, a gravitational force $F_g$ and an electrostatic gravitational force $F_e$) and a force acting in the opposite direction (that is, the surface tension $F_{st}$ of the ink), as illustrated in FIG. 1C. This equilibrium is disturbed as the electrostatic gravitation induced between the electrodes increases. Accordingly, an ink droplet is separated from the ink formed on the ink discharging surface and falls toward the print object 40 (refer to the state indicated by b in FIG. 1B).

Typically, in the electrostatic field induction ink-jet head, a voltage that is sufficient to maintain the critical state (for example, the state indicated by a of FIG. 1B), is applied constantly to the electrodes of each nozzle, and then if a particular nozzle is required to discharge the ink, an additional discharging voltage in addition to the constant voltage is applied to the particular nozzle. This allows each nozzle to be operated individually. For example, while a DC voltage (or a bias voltage) of, for example, 1 kV is applied as the constant voltage to the electrodes of the nozzles, a pulse type of alternating voltage of, for example, 0.5 kV is applied in addition to the constant voltage only to a certain nozzle that needs to be operated. Of course, it shall be evident that various other voltage-applying methods is possible.

Furthermore, it shall be evident that a nozzle that will be described hereinafter can be applied in various other applications than the electrostatic field induction ink-jet head described above. For example, the nozzle can be applied to various applications regardless of the application sector as long as the nozzle functions as a nozzle for discharging a liquid.

Figure 2:
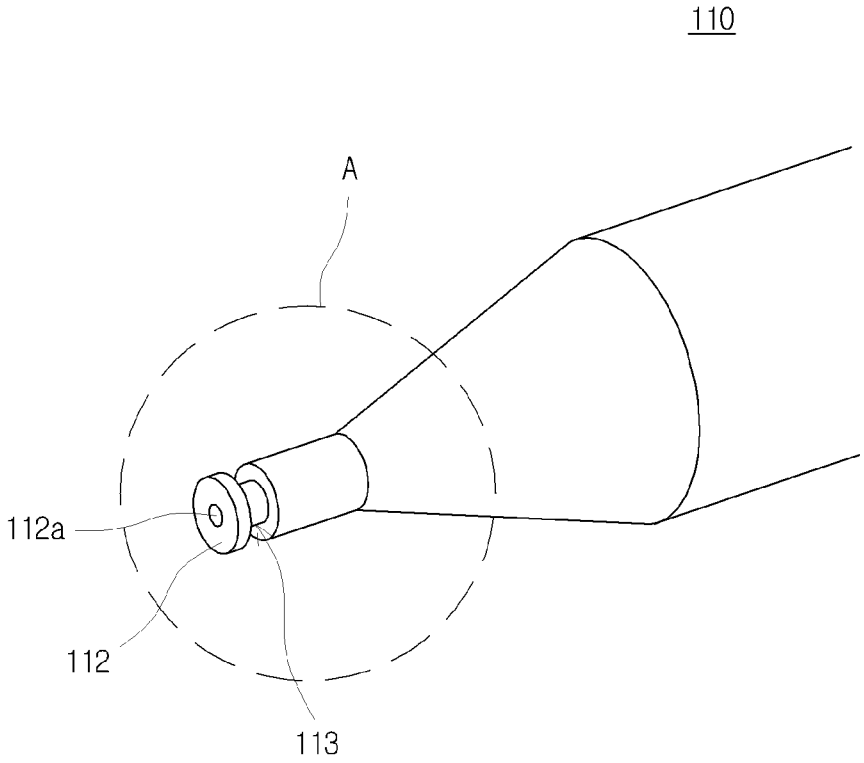
FIG. 2 is an exploded perspective view of a discharging nozzle in accordance with an embodiment of the present invention.
Figure 3:
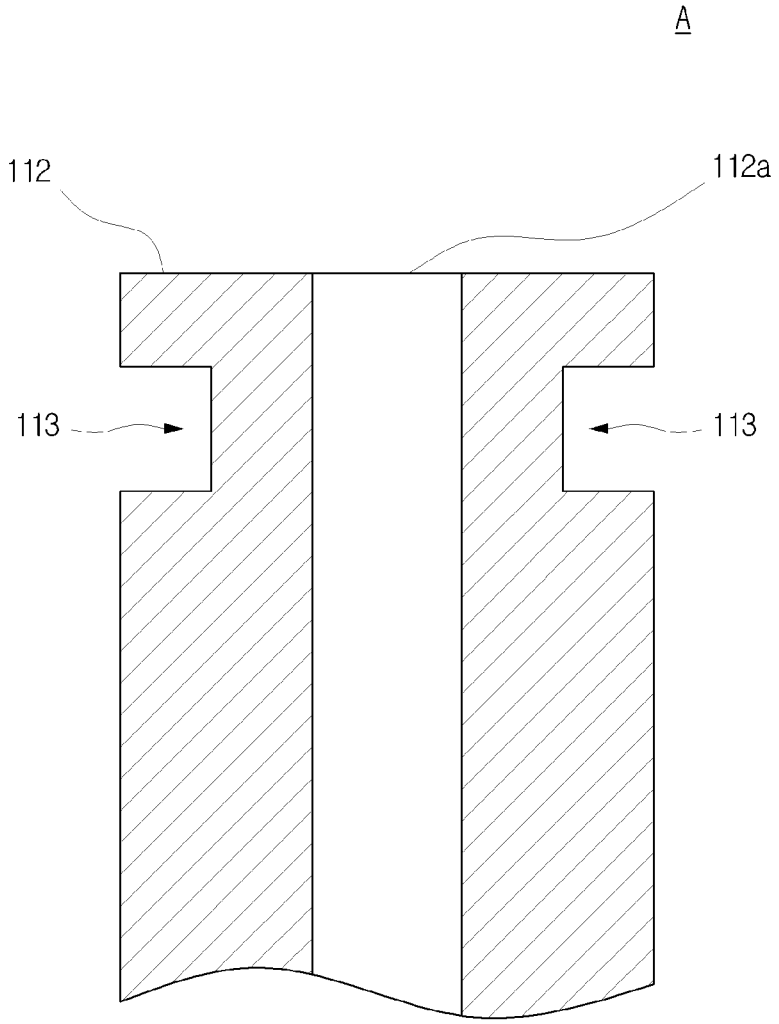
FIG. 3 is an enlarged vertical cross-sectional view of part A of FIG. 2.

FIG. 2 is an exploded perspective view of a discharging nozzle in accordance with an embodiment of the present invention, and FIG. 3 is an enlarged vertical cross-sectional view of part A (that is, an end part of the nozzle) of FIG. 2.

The nozzle 110 in accordance with an embodiment of the present invention includes a concave part 113, which is formed on an outer surface of the nozzle along the circumference adjacent to a liquid discharging surface 112. Here, the liquid discharging surface 112 refers to a surface on which a liquid discharging outlet 112*a* is formed.

Here, the concave part 113 can be formed in the shape of a ring-shaped band on the outer surface of the nozzle 110, as illustrated in FIG. 2.

In the accompanying drawings, the concave part 113 is illustrated to have a quadrangular shape (for example, a rectangle, a square and a trapezoid) in the vertical cross section, but it shall be evident that the concave part 113 can have various other shapes. For example, the vertical cross section of the concave part 113 can have various concave shapes, such as a semicircle, a two-dimensional curve, a fan and a polygon.

In the nozzle 110 of the present embodiment, in which the concave part 113 is formed on an outer surface of the nozzle along the circumference adjacent to the liquid discharging surface 112, the overflow or damping of a liquid can be minimized during a process of discharging the liquid, thereby providing a more stable discharging performance. This shall be evident through the description with reference to FIGS. 4A to 5C.

Figure 4A:
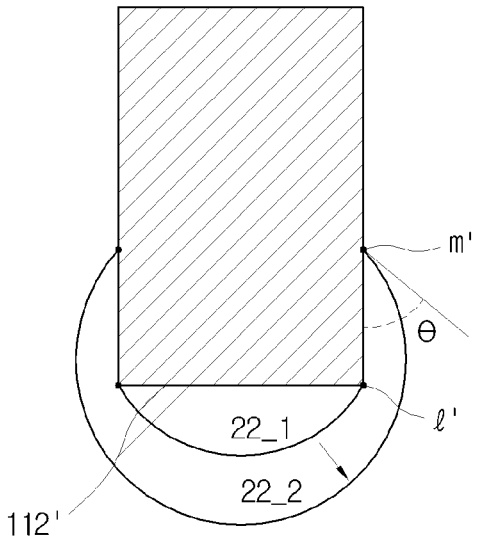
FIG. 4A PRIOR ART
FIGS. 4A, 4B and 4C are vertical cross-sectional views illustrating examples of changes in contact point between ink and an end part of a nozzle in accordance with the related art.
Figure 4B:
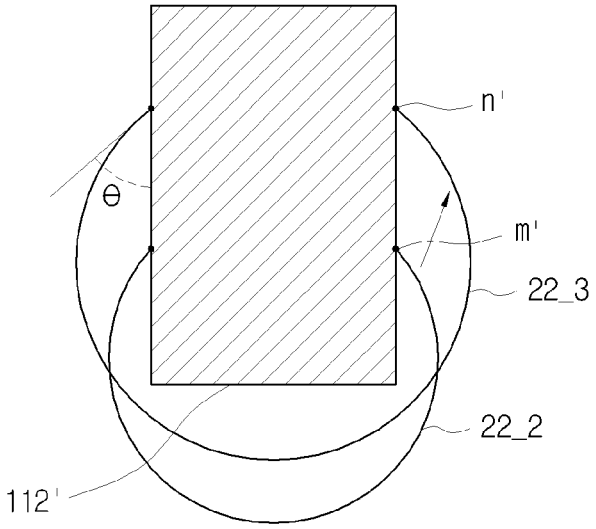
FIG. 4B PRIOR ART
Figure 4C:
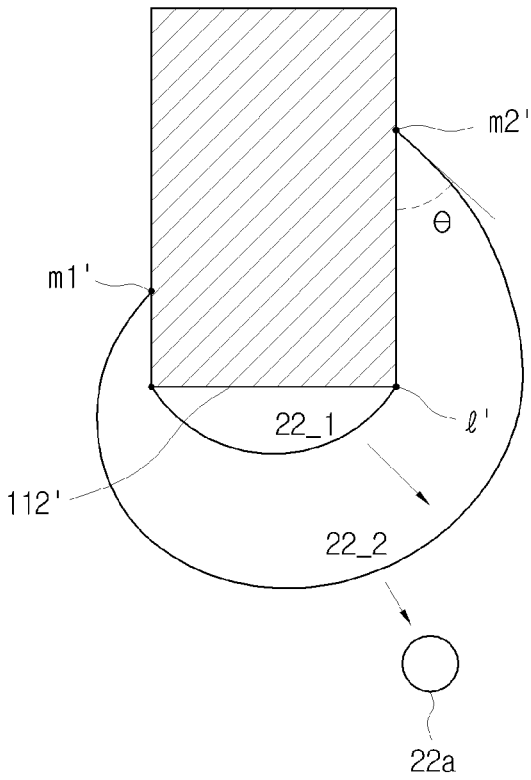
FIG. 4C PRIOR ART
Figure 5A:
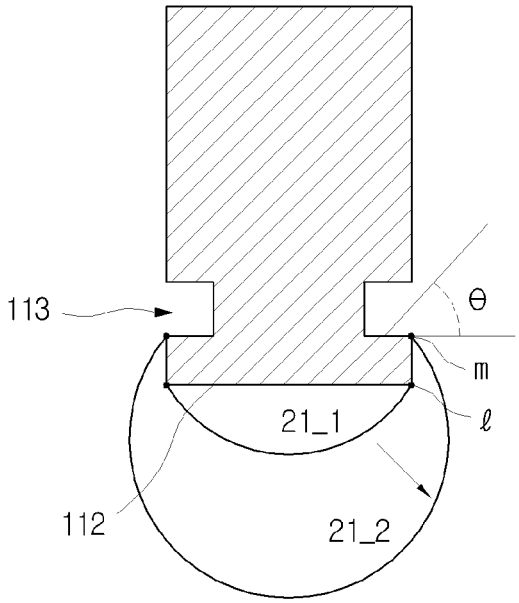
FIGS. 5A, 5B and 5C are vertical cross-sectional views illustrating examples of changes in contact point between ink and an end part of a nozzle in accordance with an embodiment of the present invention.
Figure 5B:
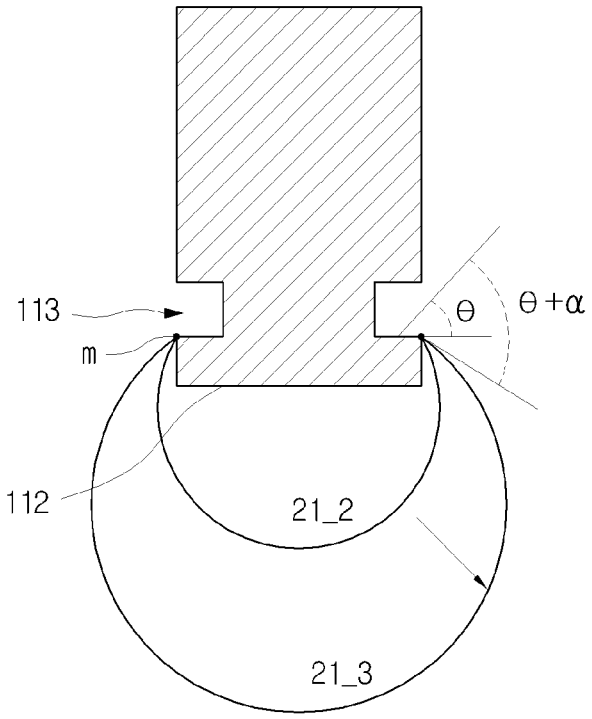
Figure 5C:
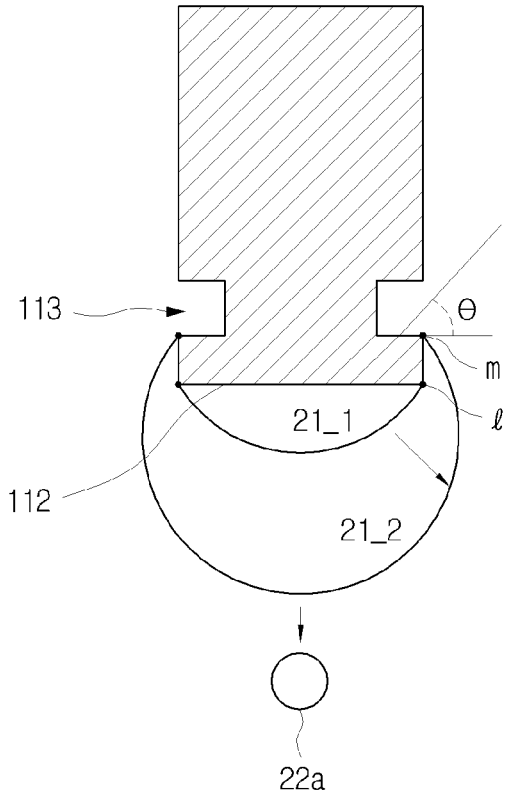

FIGS. 4A, 4B and 4C are vertical cross-sectional views illustrating examples of changes in contact point between ink and an end part of a nozzle in accordance with the related art, and FIGS. 5A, 5B and 5C are vertical cross-sectional views illustrating examples of changes in contact point between ink and an end part of a nozzle in accordance with an embodiment of the present invention. That is, FIGS. 4A, 4B and 4C illustrate a conventional nozzle that does not include a concave part 113, and FIGS. 5A, 5B and 5C illustrate a nozzle in accordance with an embodiment of the present invention that has a concave part 113 formed therein.

As the discharging of liquid through the nozzle is repeated, the meniscus of the liquid more frequently goes out of the boundary (refer to l' of FIG. 4A or l of FIG. 5A) of the liquid discharging surface 112. This is caused by the damping of the liquid discharging surface of the nozzle by the liquid.

Hereinafter, for the convenience of description, a meniscus of the liquid that is formed up to the boundary of the liquid discharging surface 112 will be referred to as a first meniscus state (refer 22_1 of FIG. 4A or 21_1 of FIG. 5A). Moreover, a meniscus of the liquid that is formed up to a point on the outer surface of the nozzle that is out of the boundary of the liquid discharging surface 112 will be referred to as a second meniscus state (refer to 22_2 of FIG. 4A or 21_2 of FIG. 5A).

As described above, as the liquid goes out of the boundary of the liquid discharging surface 112 more frequently, the contact point of the liquid moves from a first contact point l or l' to a second contact point m or m'.

With the nozzle having the concave part 113 formed therein in accordance with an embodiment of the present invention, even though the liquid overflows, the contact point of the liquid can be fixed to the point m (refer to FIG. 5A) where the concave part 113 starts. Then, even though the meniscus of the liquid becomes bigger due to an increased amount of the overflowed liquid (refer to 21_3, which is a third meniscus state, of FIG. 5B), the contact point can be fixed to the point m until the size of meniscus increases up to a certain limit.

Conversely, with the nozzle having no concave part formed therein, if the liquid overflows a liquid discharging surface 112' (refer to FIG. 4A), the contact point is formed at an arbitrary point and moves from time to time. Moreover, as the meniscus of the liquid becomes bigger (refer to 22_3 of FIG. 4B), the contact point gradually moves upward in the lengthwise direction of the outer surface of the nozzle (refer to n' of FIG. 4B).

The difference described above is resulted from the ability to impeding the overflow of the liquid (that is, the limiting ability to maintain the contact point constant) based on the presence of the concave part 113.

The limiting ability that can maintain the particular contact point constant can be expressed as a contact angle. Although the contact angle can vary based on the material of the nozzle, the type of the liquid, gas around the nozzle and the like, there is a critical angle θ that can maintain the contact point. Accordingly, if the meniscus of the liquid becomes big enough to exceed the critical angle, a change (movement) in the contact point can occur.

For this reason, since the nozzle having no concave part formed therein has the critical angle θ formed with respect to the outer surface of the nozzle, the contact point gradually moves upward in order to maintain the critical angle as the meniscus becomes bigger due to an increased amount of the liquid, as illustrated in FIG. 4A and FIG. 4B.

Conversely, since the nozzle having the concave part 113 formed therein in accordance with an embodiment of the present invention has the critical angle θ formed with respect to the inner surface of the concave part 113, the contact point may not change unless the critical angle is exceeded.

Comparing FIG. 5B with FIG. 4B, it can be seen that the critical angle of the present embodiment becomes bigger than that of the conventional nozzle (refer to θ+α of FIG. 5B). If a side wall of the concave part 113 is precisely perpendicular to the outer surface of the nozzle in FIG. 5B, the critical angle can become bigger than that of the conventional nozzle by up to 90 degrees. That is, in the present embodiment, the critical angle can be greatly expanded compared to that of the conventional nozzle because the concave part 113 is formed in the outer surface of the nozzle, thereby minimizing the change in contact point.

Although the liquid overflows, if the contact point is fixed as in the present invention, the meniscus of the liquid can be always formed at a consistent place. This can make it possible to ensure an excellent liquid discharging performance (i.e., the rate, size and direction of discharging), compared to the conventional nozzle, and ensure a stable discharging performance despite an extended operation of the nozzle.

In the conventional nozzle, however, as illustrated FIG. 4C, the contact point formed when the liquid overflows is shaped asymmetrically with respect to the center line (refer to m1' and m2' in FIG. 4C), and thus the liquid may be discharged in a direction that is different from the intended direction of travel (refer to reference numeral 22*a* of FIG. 5). On the other hand, the nozzle in accordance with an embodiment of the present embodiment has the contact point fixed to the concave part 113 and shaped symmetrically with respect to the center line, and thus the discharging direction of the liquid does not change.

Hitherto, a nozzle in accordance with an embodiment of the present invention has been described with reference to FIG. 2, FIG. 3, FIG. 5A, FIG. 5B and FIG. 5C. However, the present invention is not limited to this embodiment, and various other permutations are possible. Hereinafter, a nozzle in accordance with other embodiments of the present invention will be described with reference to FIGS. 6A to 9.

FIGS. 6A, 6B, 7A, 7B, 8 and 9 are vertical cross-sectional views illustrating discharging nozzles in accordance with certain other embodiments of the present invention.

Figure 6A:
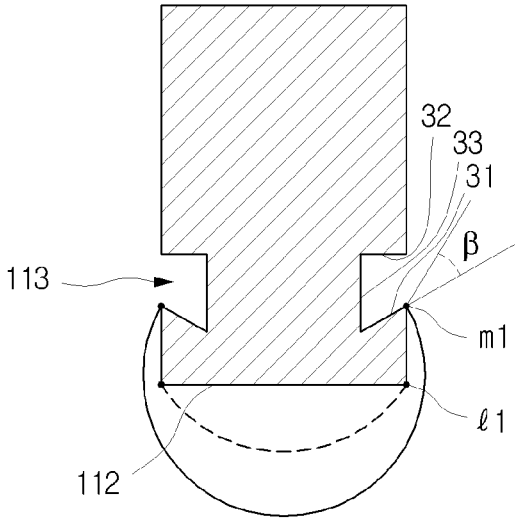
FIGS. 6A, 6B, 7A, 7B, 8 and 9 are vertical cross-sectional views illustrating a discharging nozzle in accordance with other embodiments of the present invention.

Referring to FIG. 6A, among two side walls 31 and 32, which are formed by the concave part 113, the angle between a first side wall 31, which is closer to the liquid discharging surface 112, and a base part 33 of the concave part 113 is an acute angle.

In this case, since the critical angle is formed with reference to the inclined surface of the acute angle formed by the first side wall 32, the critical angle can be further expanded, compared to that of the embodiment of FIGS. 2 and 3 (refer to β in FIG. 6A).

Figure 6B:
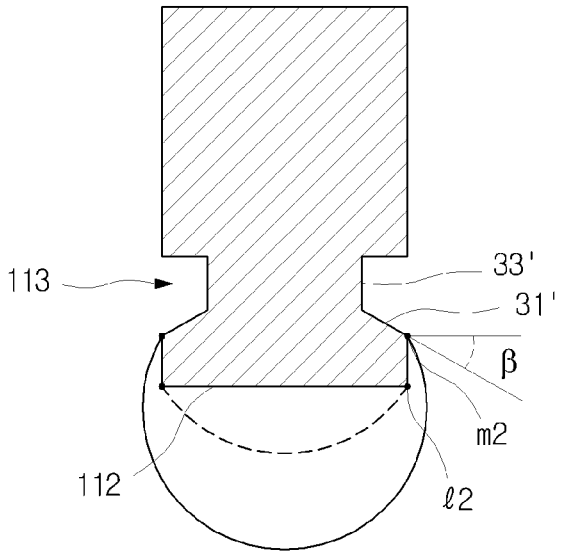

Conversely, in FIG. 6B, the angle between a first side wall 31' and a base part 33' of the concave part 113 is an obtuse angle. In the case of FIG. 6B, although the critical angle is reduced (refer to β in FIG. 6B) narrower than that of the embodiment of FIGS. 2 and 3, it still has a wider critical angle than that of the conventional nozzle.

Figure 7A:
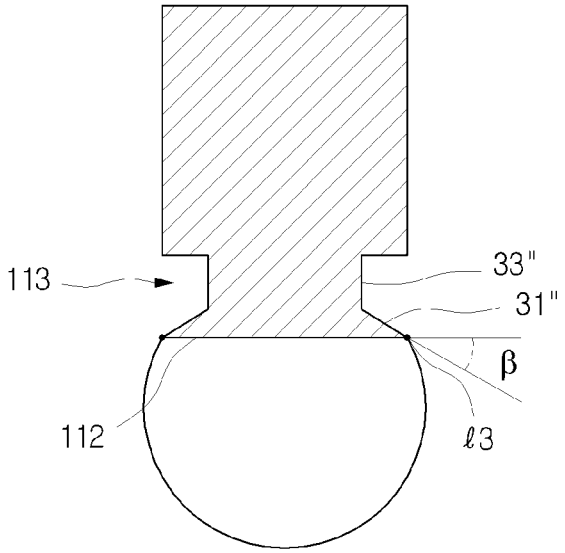

Furthermore, in FIG. 7A, the angle between a first side wall 31" and a base part 33" is an obtuse angle, but the inclined surface of the obtuse angle formed by the first side wall 31" is extended to the liquid discharging surface 112. In the case of FIG. 7A, the critical angle is reduced narrower than that of the embodiment of FIGS. 2 and 3 (refer to β in FIG. 7A). In this case, however, since the contact point is formed at a point l3 from the very first, the discharging stability can be further increased.

Figure 7B:
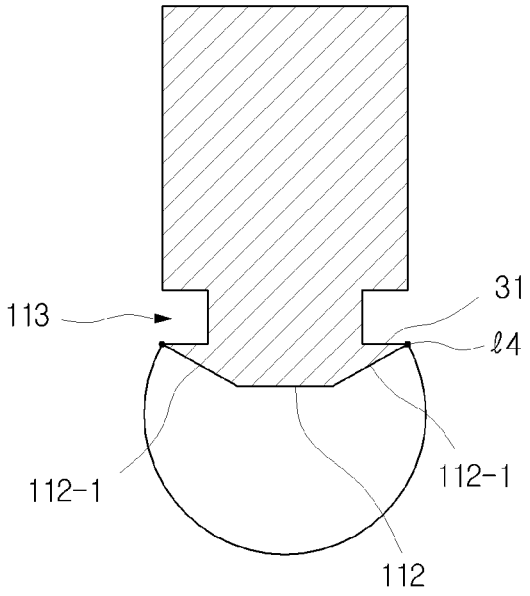

In FIG. 7B, an inclined surface 112-1 is formed along the perimeter of the liquid discharging surface 112, but the inclined surface 112-1 is extended to a start point l4 of the first side wall 31 of the concave part 113. In the case of FIG. 7B, the critical angle can be increased, similarly to FIG. 6A, and the contact point can be formed at the point l4 from the very first, similarly to FIG. 7A.

Figure 8:
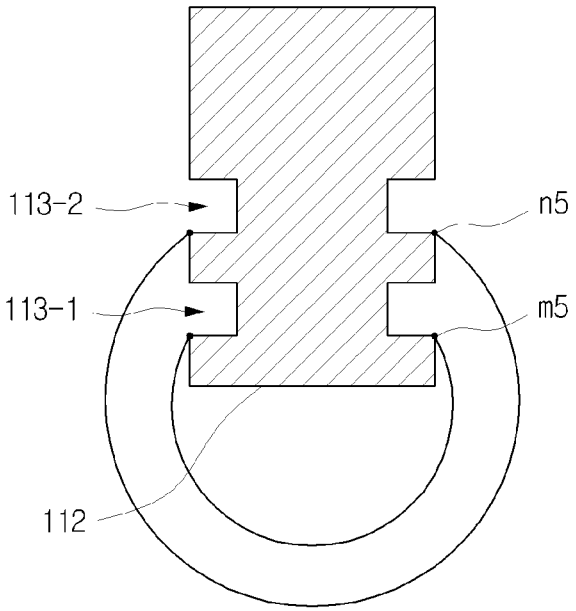

In FIG. 8, a plurality of concave parts 113-1 and 113-2 are formed in the lengthwise direction of the nozzle. In this case, even if the contact point exceeds a first critical point m5 formed by the first concave part 113-1, the equilibrium can be retained by a second critical point n5 formed by the second concave part 113-2. That is, since the second concave part 113-2 functions as a buffering zone, stability in the discharging performance can be provided.

Figure 9:
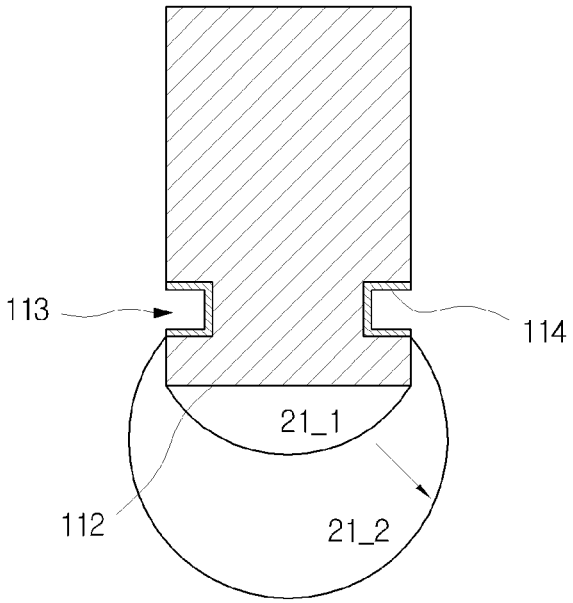

In FIG. 9, a hydrophobic coating membrane 114 is coated on the surface of the concave part 113. By coating the hydrophobic coating membrane 114 on the concave part 113, the critical angle can be expanded.

Although the hydrophobic coating membrane 114 is coated on the surface of the concave part 113, as illustrated in FIG. 9, it is also possible that the surface of the concave part 113 is made of a hydrophobic material to achieve the same expected result.

While the spirit of the present invention has been described in detail with reference to particular embodiments, the embodiments are for illustrative purposes only and shall not limit the present invention. It is to be appreciated that those skilled in the art can change or modify the embodiments without departing from the scope and spirit of the present invention.

As such, many embodiments other than those set forth above can be found in the appended claims.

What is claimed is:

1. A nozzle comprising a concave part formed along an outer circumference surface of the nozzle, the outer circumference surface being adjacent to a liquid discharging surface, wherein the liquid discharging surface is a planar surface of the nozzle being in a tube shape, and the outer circumference surface is a side surface extended in a different plane than the planar surface, wherein the concave part extends along an entire circumference of the side surface and is parallel to the liquid discharging surface along a longitudinal axis of the nozzle, the concave part being separated from the liquid discharging surface by a portion of the side surface.

2. The nozzle of claim 1, wherein the concave part is formed in the shape of a ring-shaped band at the outer circumference surface of the nozzle.

3. The nozzle of claim 1, wherein a plurality of concave parts are formed in a lengthwise direction of the nozzle.

4. The nozzle of claim 1, wherein a hydrophobic coating membrane is coated on a surface of the concave part.

5. The nozzle of claim 1, a surface of the concave part is made of a hydrophobic material.

6. The nozzle of claim 1, wherein, among two side walls formed by the concave part, an angle formed by a first side wall and a base part of the concave part is an acute angle, the first side wall being closer to the liquid discharging surface.

7. The nozzle of claim 1, wherein, among two side walls formed by the concave part, an angle formed by a first side wall and a base part of the concave part is an obtuse angle, the first side wall being closer to the liquid discharging surface, wherein an inclined surface of the obtuse angle formed by the first side wall is extended to the liquid discharging surface.

8. The nozzle of claim 1, wherein an inclined surface is formed along a perimeter of the liquid discharging surface, and the inclined surface is extended to a start point of a side wall of the concave part.

9. An electrostatic field induction ink-jet nozzle configured to discharge ink by using an electrostatic field formed by a difference in electric potential of electrodes, wherein the nozzle comprises a concave part formed along an outer circumference surface of the nozzle, the outer circumference surface being adjacent to a liquid discharging surface, wherein the concave part extends along an entire circumference of the side surface and is parallel to the liquid discharging surface along a longitudinal axis of the nozzle, the concave part being separated from the liquid discharging surface by a portion of the side surface.

10. The nozzle of claim 9, wherein the concave part is formed in the shape of a ring-shaped band at the outer circumference of the nozzle.

11. The nozzle of claim 9, wherein a plurality of concave parts are formed in a lengthwise direction of the nozzle.

12. The nozzle of claim 9, wherein a hydrophobic coating membrane is coated on a surface of the concave part.

13. The nozzle of claim 9, wherein a surface of the concave part is made of a hydrophobic material.

14. The nozzle of claim 9, wherein, among two side walls formed by the concave part, an angle formed by a first side wall and a base part of the concave part is an acute angle, the first side wall being closer to the liquid discharging surface.

15. The nozzle of claim 9, wherein, among two side walls formed by the concave part, an angle formed by a first side wall and a base part of the concave part is an obtuse angle, the first side wall being closer to the liquid discharging surface, wherein an inclined surface of the obtuse angle formed by the first side wall is extended to the liquid discharging surface.

16. The nozzle of claim 9, wherein an inclined surface is formed along a perimeter of the liquid discharging surface, and the inclined surface is extended to a start point of a side wall of the concave part.

* * * * *